United States Patent [19]

Shiraishi

[11] 4,127,963

[45] Dec. 5, 1978

[54] TOY DRAWING DOLL

[75] Inventor: Hisashi Shiraishi, Tokyo, Japan

[73] Assignee: Tomy Kogyo Co., Inc., Tokyo, Japan

[21] Appl. No.: 742,880

[22] Filed: Nov. 18, 1976

[30] Foreign Application Priority Data

Apr. 16, 1976 [JP] Japan ..... 51-48556[U]

[51] Int. Cl.[2] ..... A63H 33/24

[52] U.S. Cl. ..... 46/265; 46/120

[58] Field of Search ..... 46/116, 119, 120, 264, 46/265

[56] References Cited

U.S. PATENT DOCUMENTS

| | | | |
|---|---|---|---|
| 3,142,131 | 7/1964 | Von Rabenau | 46/119 |
| 3,436,859 | 4/1969 | Dekan | 46/265 |
| 3,581,433 | 6/1971 | Meyer et al. | 46/116 |
| 3,684,291 | 8/1972 | Johmann | 46/264 X |
| 3,834,070 | 9/1974 | Breslow | 46/116 |

*Primary Examiner*—Louis G. Mancene
*Assistant Examiner*—Robert F. Cutting
*Attorney, Agent, or Firm*—Staas & Halsey

[57] ABSTRACT

A toy doll provided with a torso and arms mounted to move with respect to the torso, a writing instrument to be held by one of the arms, a motor, a mechanism operatively connecting the one arm to the motor to cause the arm to oscillate with respect to the torso to move the writing instrument in a predetermined pattern, a platform provided with a plate mounted to rotate with respect to the platform and on top of which there is provided a drawing medium, and a mechanism operatively connecting the motor to the plate through the other of the arms to cause the plate and the writing medium contained thereon to rotate, the drawing that is provided being the result of the combined oscillating movement of the writing instrument and the rotation of the medium engaged by the writing instrument.

15 Claims, 10 Drawing Figures

TOY DRAWING DOLL

BACKGROUND OF THE INVENTION

The present invention relates to a toy drawing doll, and in particular to the combination of a doll which is provided with one arm that holds the writing instrument and which is caused to oscillate, and a stand provided with a rotating disc on top of which the drawing medium engaged by the writing instrument is positioned, the plate being caused to rotate by a mechanism which operatively connects through the other of the doll's arms the motor which is located in the torso and the rotating plate. The writing instrument is held between the fingers of a hand which is mounted to rotate with respect to the oscillating arm so that it is possible for the child to change the position of the writing instrument relative to the rotating medium to vary the pattern thereon. Moreover, a manually operable mechanism is provided for changing the speed of rotation of the disc and the writing medium contained thereon. Finally, the aforesaid oscillating movement of the doll's arm is accompnied by a waving movement of the doll's head.

DESCRIPTION OF THE PREFERRED EMBODIMENT

Figure 1:
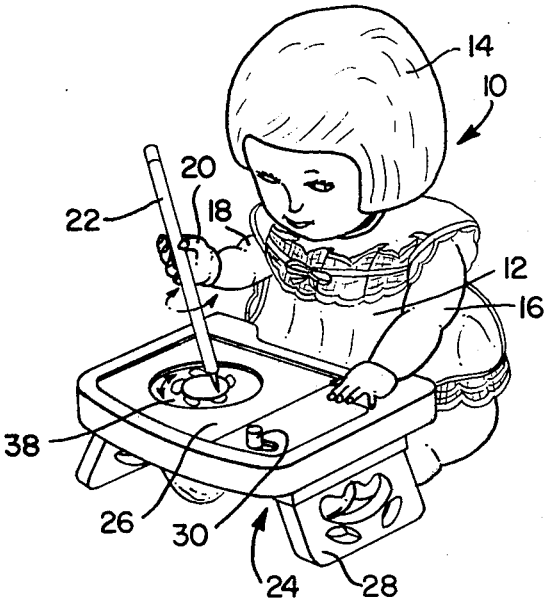
FIG. 1 is a perspective view of the toy drawing doll of the present invention, illustrating generally the oscillating movement of one of the arms of the doll which holds the writing instrument, and the stand which is provided with a rotating disc upon which the writing medium, for example, paper, is positioned.

The toy drawing doll of the present invention is illustrated in FIG. 1, and consists of a doll 10 provided with a torso 12, head 14, left arm 16 and right arm 18 to which a hand 20 holding a writing instrument 22 is connected. The stand 24 is provided with a platform 26 supported by legs 28, the manually operable switch 30 extending upwardly through the platform 26.

Figure 2:
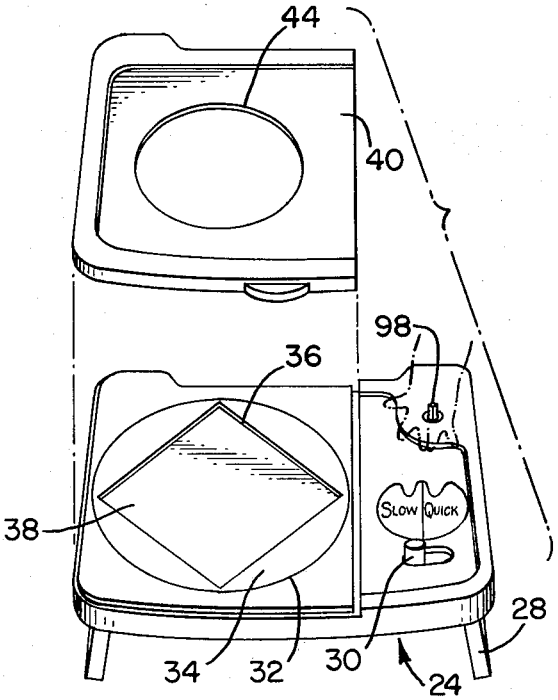
FIG. 2 is a perspective view of the writing stand with the top plate thereof raised to expose the rotating disc upon which a sheet of paper is positioned, and the manually operable control for changing the speed of rotation of the disc.

Turning now to FIG. 2, it will be apparent that the stand 24 is provided with an opening 32 within which a circular disc 34 is mounted for rotation. The disc 34 is provided with a generally square-shaped opening 36 within which the drawing medium 38, for example, a sheet of paper, is positioned. A plate 40 normally rests on top of the platform 26, and is provided with a circular opening 44 therein so as to expose the paper 38.

Figure 7:
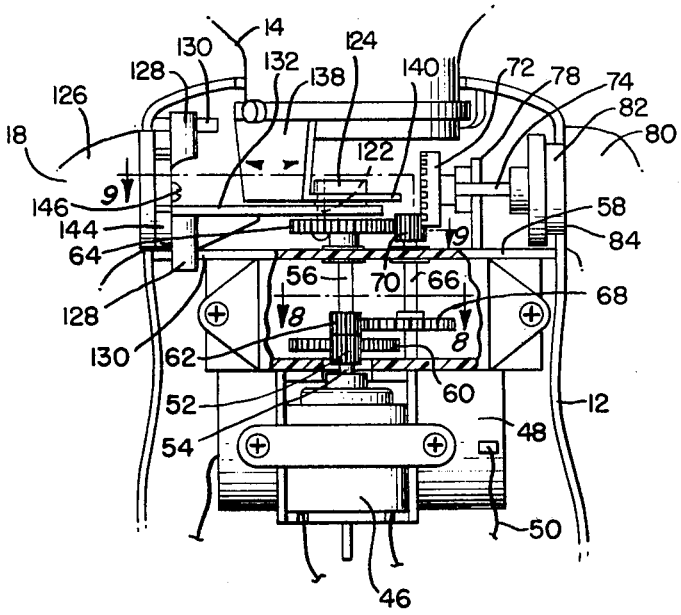
FIG. 7 is a front elevational view of a part of the torso of the doll with part of the casing thereof removed so as to expose the internal working mechanisms, including the motor, gear train, and system for permitting one of the arms to oscillate.
Figure 8:
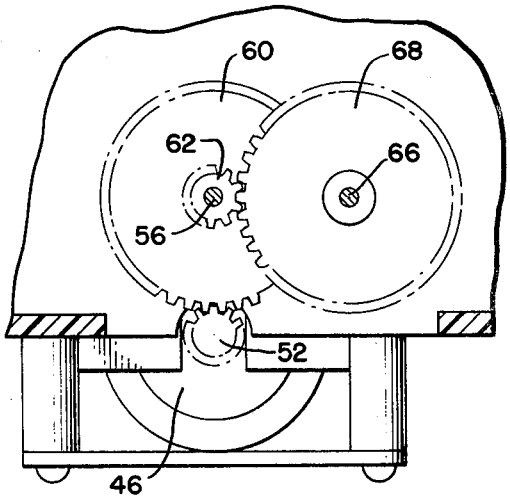
FIG. 8 is a sectional view taken along line 8—8 of FIG. 7 showing a part of the gear train mechanism.

Turning now to FIG. 7, it will be apparent that within the torso 12 of the doll 10 there is located a miniature electric motor 46 which is of conventional design well known in the art, a housing 48 within which a battery (not shown) is located, and appropriate wiring 50 to connect the motor 46 and the battery. In this manner, when a switch (not shown) is turn on by the child, the motor 46 is energized causing the gear 42 mounted to the shaft 54 of the motor 46 to rotate.

A shaft 56 is appropriately journalled within the walls 58 of a chasis within the torso 12. Fixedly secured to the shaft 56 is a large gear 60 which terminates upwardly in a smaller gear 62, and a large gear 64. The gear 52 driven by the motor 46 meshes with the gear 60 causing the shaft 56 to rotate. Another shaft 66 is also suitably journalled within the walls 58 for rotation, and fixedly secured thereto are a large gear 68 and a small gear 70. It will be apparent that the gear 62 meshes with the gear 68 causing the shaft 66 to rotate.

Figure 6:
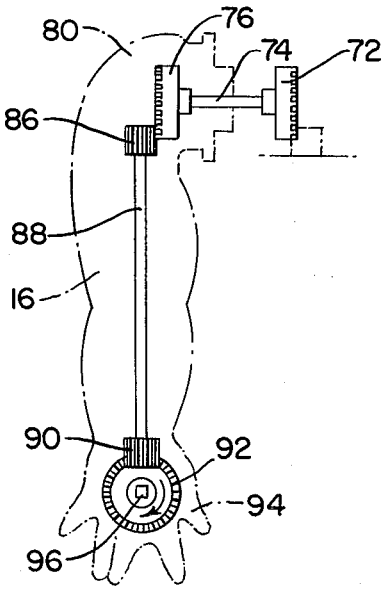
FIG. 6 is a top plan view of one of the arms of the toy doll with the outer configuration thereof shown in dotted lines so as to expose the gearing mechanism contained therein which operatively connects the motor contained within the torso of the doll to the rotating disc provided in the stand.

With reference to FIGS. 6–7, it will be apparent that the rotating gear 70 meshes with a crown gear 72 that is mounted to one end of a shaft 74, the outer end of which is provided with a crown gear 76. The shaft 74 is appropriately journalled to the wall 78 and, moreover, the upper portion 80 of the arm 16 is provided with a circular groove 82 which fits within an opening 84 provided in the side of the torso 12 such that the arm 16 is free to move relative to the torso 12. The rotating crown gear 76 within the upper portion 80 of the arm 16 meshes with a gear 86 which is secured to a shaft 88 which is appropriately mounted for rotation within the arm 16. It should be noted that the plastic material of which the arm 16 is constructed is provided with the necessary structures to support the shafts 74 and 88 so as to permit same to rotate. The shaft 88 terminates at the other end thereof in a gear 90 which meshes with a gear 92 located in the hand 94, such that rotation of the shaft 88 causes the gear 92 to rotate. The gear 92 is provided with a recessed opening 96 which is generally square in cross section which encloses the shaft 98 which is also square in cross section, as illustrated in FIG. 2. From the foregoing, it will be apparent that through the gearing mechanisms previously described, the motor 46 is responsible for driving through the left arm 16 of the doll 10 the shaft 98 which protrudes upwardly through the top of the drawing table 24.

Figure 4:
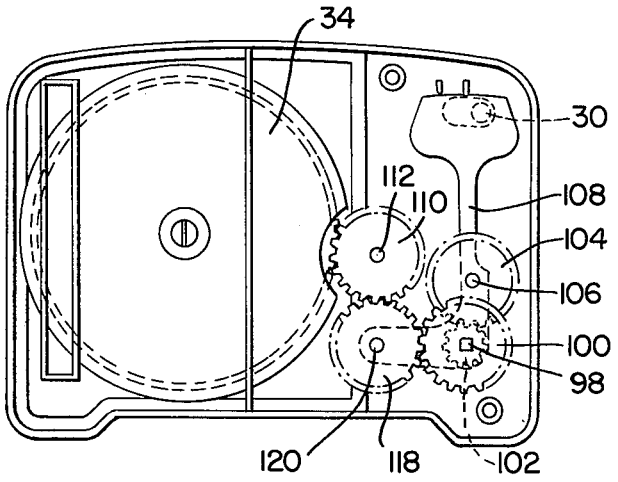
FIG. 4 is a bottom plan view of the stand with a part of the casing thereof removed so as to expose the internal working mechanism, and in particular the relationship of the gear mechanisms when the manually operable adjustment device is set to rotate the disc rapidly.
Figure 5:
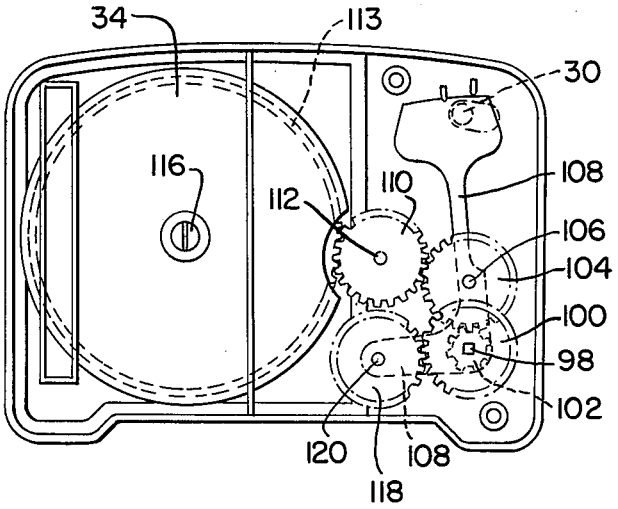
FIG. 5 is a bottom plan view of the drawing stand with a portion of the casing thereof removed, illustrating in particular the relationship of the gear mechanism when the manually operable control device is set to rotate the disc slowly.

Turning now to FIGS. 4–5, it will be apparent that the square-shaped shaft 98 is attached to a large gear 100 which is also provided with a smaller gear 102 which meshes with a gear 104 which is mounted to a shaft 106 which is secured to a rod 108 which is provided with an opening through which the square-shaped shaft 98 extends. It will be apparent therefor that the shaft 98 rotates the smaller gear 102 which meshes with the gear 104 causing same to rotate. The gear 104 may mesh with a gear 110 which is mounted to a shaft 112 which is appropriately journalled to the casing of the stand 24 for rotation. The teeth of the gear 110 mesh with a continuous rack of teeth 113 which are formed along the periphery of the rotating plate 34 which is secured to a shaft 116 which is appropriately journalled for rotation with respect to the casing of the stand 24. In similar manner, a gear 118 is mounted to a shaft 120 which is secured to the rod 108.

From the foregoing, it will be apparent that when the manually operable switch 30 is moved by the child to the position illustrated in FIG. 4, the gears 104 and 110 are not in engagement with each other, and thus rotation of the gear 100 causes the gear 118 to rotate which in turn causes the gear 110 to rotate which in turn causes the plate 34 upon which the drawing medium or paper 38 is positioned to rotate. By moving the switch 30 to the position illustrated in FIG. 5, it will be apparent that the gears 104 and 110 engage each other, whereas the gears 118 and 110 no longer engage each other. Thus, the rotation of the gear 100 causes the gear 104 to rotate, which, in turn, causes the gear 110 to rotate which, in turn, causes the plate 34 upon which the paper 38 is positioned to rotate. In the position illustrated in FIG. 4, it will be apparent that the teeth along the outer surfaces of the gears 100, 118 and 110 engage each other promoting a relatively rapid rotation of the plate 34, whereas in the position illustrated in FIG. 5, the smaller gear 102 engages the gear 104 resulting in imparting a rotational velocity to the gear 104 which is less than the rotational velocity imparted to the gear 108 by its larger teeth of the gear 102. Thus the plate 34 is caused to rotate slower when the gears are aligned as in FIG. 5.

Figure 9:
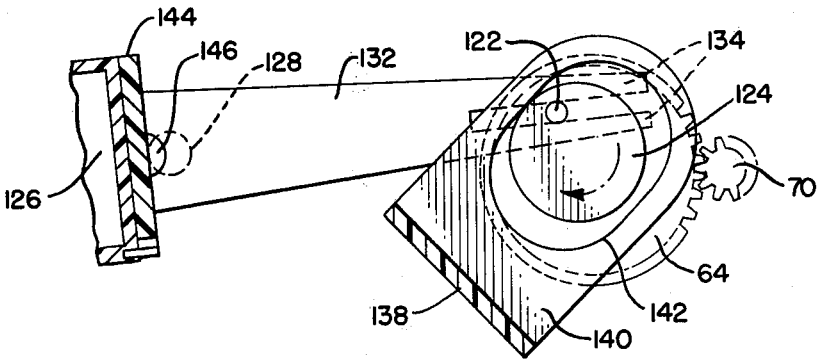
FIG. 9 is a sectional view taken along line 9—9 of FIG. 7 showing the mechanism for causing one of the arms within which the writing instrument is held to oscillate.
Figure 10:
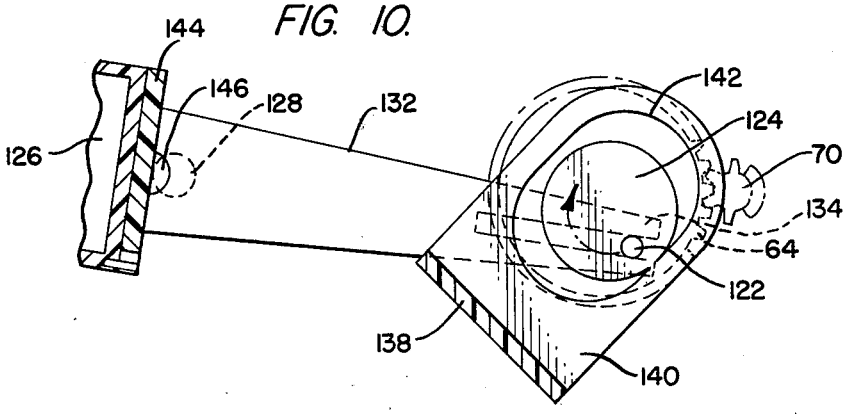
FIG. 10 is a sectional view taken along the line 9—9 of FIG. 7 showing the arm having been oscillated to a position different from that shown in FIG. 9.

Returning to FIG. 7, it will be apparent that the gear 64 is provided with a fastener 122 which is also attached to a block 124 so as to suspend the block 124 away from the gear 64. The block 124, as seen in FIGS. 9–10, is generally circular in cross section, and the fastener 122 is offset from the center of the block 124. The upper portion 126 of the right arm 18 is provided with two shafts 128 which fit within slotted surfaces 130 formed as a part of the torso 12, such that the arm 18 is free to rotate relative to the torso 12 about the shafts 128. Attached to the upper portion 126 of the arm 18 is a shoulder 132 which terminates at its free end in arms 134, it being noted from FIGS. 9–10 that the fastener 122 is located between the arms 134. Thus, the motor 46 causes the gear 64 to rotate, the fastener 122 which is offset from the center of rotation of the gear 64 causes the shoulder 132 to rock back and forth in turn causing the arm 18 to rotate about the shafts 128.

Figure 3:
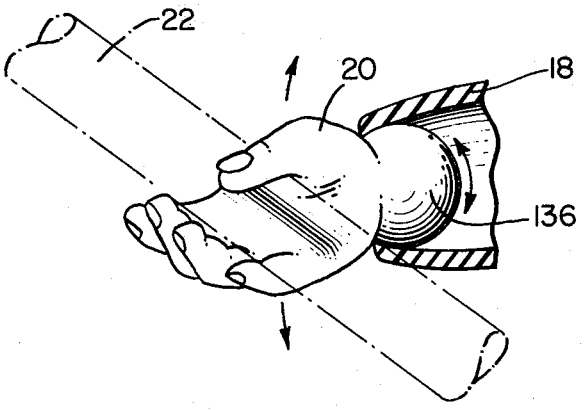
FIG. 3 is a perspective view illustrating the positioning of the writing instrument within the hand of the doll which is formed with a ball joint connection to the arm so as to permit the position of the writing instrument relative to the writing medium to be varied to change the design.

Turning to FIG. 3, it will be apparent that the hand 20 is attached to the right arm 18 through a ball joint connection 136 in such a manner that the hand 20 may be rotated relative to the arm 18.

Returning to FIG. 7, it will be apparent that the reference numeral 138 designates a collar which is appropriately mounted to the upper portion of the torso 12 adjacent the lower portion of the head 14 of the doll 10. The collar 138 is provided with a lower flange 140 which, as illustrated in FIGS. 9–10 is provided with an elongated opening 142. From FIGS. 7 and 9–10 it will be apparent that the block 124 fits within the elongated opening 142 of the flange 140. The rotation of the block 124 about the fastener 122 causes the block 124 to sequentially engage the sides of the opening 142 of the flange 140 moving same from side to side. It will be apparent from FIG. 7 that the head 14 of the doll 10 is mounted to the collar 138, and thus as the flange 140 rocks from side to side the head 14 of the doll also moves.

As seen in FIGS. 7 and 9–10, the shoulder 132 is provided with an upstanding flange 144, and a fastener 146 loosely secures the flange 144 to the upper arm 126 such that the right arm 18 may be manually rotated relative to the torso 12 such that the child may raise and lower the arm 18 and the writing instrument 22 held thereby.

I claim:

1. A toy drawing doll, comprising:

a doll having a torso, a first arm movably mounted to said torso for holding a drawing instrument, and a second arm mounted to said torso;

a platform having a rotatably mounted plate thereon for holding a medium to be drawn on;

a motor within said torso hidden from view;

means operatively connecting said first arm and said motor to move said first arm with respect to said torso such that the drawing instrument to be held by said first arm moves in relationship to said plate of said platform; and means operatively connecting said motor and said plate through said second arm so as to be hidden from view for rotating said plate and the drawing medium to be carried thereby, such that the design imparted by the drawing instrument to be carried by said first arm on the medium to be carried by said plate is the result of both the movement of said first arm and the movement of said plate.

2. A toy drawing doll as in claim 1, further comprising a hand and means mounting said hand to rotate with respect to the end of said first arm such that the drawing instrument may be attached to said hand and the position of the drawing instrument changed.

3. A toy drawing doll as in claim 1, further comprising a head mounted to move with respect to said torso, and means moving said head during operation of said motor.

4. A toy drawing doll as in claim 1, wherein said means operatively connecting said first arm and said motor comprises a member attached to said arm and having a portion thereof extending inwardly within said torso, a wheel mounted to rotate about an axis within said torso, means connecting said inwardly extending portion of said member to said wheel at a position offset from said axis thereof, and means operatively connecting said motor and said wheel.

5. A toy drawing doll as in claim 4, further comprising a shaft attached to said member and a socket provided within said torso, said shaft mounted within said socket to rotate therein.

6. A toy doll as in claim 1, wherein said means operatively connecting said motor and said plate comprises gear train means within said second arm, means connecting said gear train means to said motor, gear train means within said writing platform connected to said plate, and means operatively connecting said gear train means within said writing platform and said gear train means within said second arm.

7. A toy doll as in claim 6, wherein said means operatively connecting said gear train means within said writing platform and said gear train means within said second arm comprises a shaft mounted to said gear train means within said writing platform and extending outwardly of said platform through an opening therein, a rotatably mounted element attached to the end of said gear train means within said second arm and provided with an opening into which said shaft extends.

8. A toy drawing doll as in claim 1, including means varying the speed of rotation of said plate.

9. A toy drawing doll as in claim 8, wherein said means varying the speed of rotation of said plate comprises a manually operable button mounted on said writing platform to move between two positions, said means operatively connecting said motor to said plate comprising gear train means operable to rotate said plate at one speed when said button is on one of said two positions and to rotate said plate at a different speed when said button is in the other of said two positions.

10. A toy drawing doll as in claim 1, further comprising a head mounted to move with respect to said torso, and means operatively connecting said motor to said head to move said head.

11. A toy drawing doll, comprising a doll having a torso, a first arm, means mounting said first arm to said torso to move about a first axis, a member extending from said arm into said torso, a second arm, a platform, a plate mounted to rotate with respect to said platform, a motor, a gear wheel, gear train means connecting said motor and said gear wheel to rotate said wheel about a second axis, means connecting said member of said first arm to said gear wheel at a position off-set from said second axis, and a gear mechanism operatively connecting said motor and said plate including portions thereof located inside said second arm for rotating said plate.

12. A toy drawing doll as in claim 11, further comprising a hand, means mounting said hand to rotate with respect to said first arm, a writing instrument for attachment to said hand, and a medium to be drawn on for positioning on said plate of said platform.

13. A toy drawing doll as in claim 11, including means varying the speed of rotation of said plate.

14. A toy drawing doll as in claim 12, further comprising a head mounted to move with respect to said torso, and means operatively connecting said motor and said head to move said head.

15. A toy drawing doll as in claim 11, wherein said means connecting said member of said first arm to said gear wheel at a position off-set from said second axis comprises a block spaced from said gear wheel and a shaft off-set from said second axis connecting said block and said gear wheel, and wherein said member of said first arm is provided with a slot, within which said shaft is positioned.

* * * * *